US006228190B1

(12) United States Patent
Debenham

(10) Patent No.: US 6,228,190 B1
(45) Date of Patent: May 8, 2001

(54) EXTRUDABLE GUN PROPELLANT COMPOSITION

(75) Inventor: David Frank Debenham, St Albans (GB)

(73) Assignee: The Secretary of State for Defence in Her Brittanic Majesty's Government of the United Kingdom of Great Britain and Northern Ireland, London (GB)

( * ) Notice: Subject to any disclaimer, the term of this patent is extended or adjusted under 35 U.S.C. 154(b) by 0 days.

(21) Appl. No.: 07/731,401

(22) Filed: Jun. 28, 1991

(30) Foreign Application Priority Data

Jul. 2, 1990 (GB) ..... 9014647

(51) Int. Cl.[7] ..... C06B 45/10
(52) U.S. Cl. ..... 149/19.4; 149/19.6
(58) Field of Search ..... 149/19.4, 19.6

(56) References Cited

U.S. PATENT DOCUMENTS 4,483,978 * 11/1984 Manser ..... 149/19.6
4,555,277 * 11/1985 Scribner ..... 179/19.4
4,560,779 * 12/1985 Guimont et al. ..... 149/19.4
4,707,540 * 11/1987 Manser et al. ..... 149/19.4
4,764,586 * 8/1988 Manser et al. ..... 149/19.4
4,919,737 * 4/1990 Biddle et al. ..... 149/19.6
5,099,042 * 3/1992 Wardle et al. ..... 149/19.6
5,210,179 * 5/1993 Stewart ..... 528/408
5,313,000 * 5/1994 Stewart ..... 528/613
5,747,603 * 5/1998 Hinshaw et al. ..... 149/19.4

* cited by examiner

*Primary Examiner*—Edward A. Miller
(74) *Attorney, Agent, or Firm*—Nixon & Vanderhye

(57) ABSTRACT

The invention provides an extrudable gun propellant having a specific energy content of at least 1100 kJ/kg and typically over 1200 kJ/kg, but with reduced vulnerability to shaped charge attack compared to known colloidal propellants. This is achieved by using an energetic binder prepolymer and an energetic plasticiser with a reduced content of explosive filler. The composition comprises 65–85% by weight particulate explosive filler, 10–30% by weight of a mixture of a funtionally-terminated poly(nitratoalkyl-substituted)alkyl ether prepolymer and a cross-linking agent, and 1–12% by weight of energetic plasticiser.

9 Claims, 1 Drawing Sheet

EXTRUDABLE GUN PROPELLANT COMPOSITION

Figure 1:
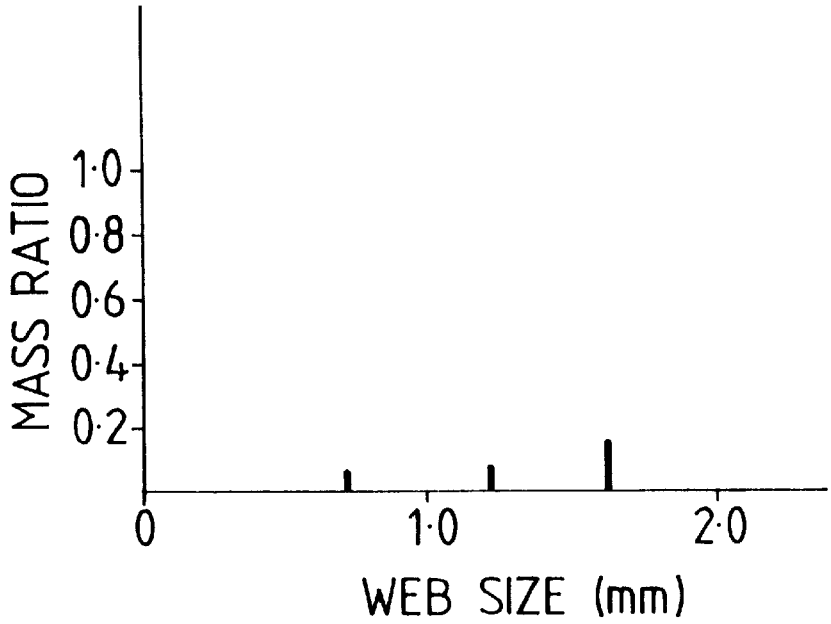

This invention relates to an extrudable gun propellant composition and to extruded gun propellant prepared therefrom.

A wide range of extrudable propellant formulations are known which are based upon mixtures of nitroglycerine (NG) and nitrocellulose (NC). The manufacture of NC/NG based propellant (also known as colloidal propellant) such as double base propellant (based upon NG and NC alone) and triple base propellant (based on mixtures of NG, NC and picrite), requires many stages of ingredient mixing with a final stage of solvent inclusion, to enable an extrudable dough to be formed. Once extruded into the desired shape such as slotted tubes or longitudinally perforated sticks, the extrudate is stoved to remove the solvent and a fairly brittle propellant results whose physical properties depend essentially on a cellulosic framework encapsulating a solution of NG.

The main requirements for an extrudable gun propellant are that it should possess a high specific energy content compatible with the needs of modern high performance ammunition for artillery and battle tank guns in particular, and it should be processable into the desired propellant shape. The first requirement means that the force constant (F) of the cured propellant should ideally be at least 1100 kJ/kg, where:

$$F=nRT_o$$

in which n=the number of moles of propellant gas products per kg of propellant

R=gas constant $T_o$=the adiabatic flame temperature

The second requirement is met by ensuring that at a typical propellant processing temperature (usually between 30° C. and 70° C.) the extrudable gun propellant possesses a viscosity within a range that permits relative ease of extrusion into the required propellant shape for incorporation into a gun propellant charge and yet also ensures that the extrudate once formed is relatively free from stickiness and maintains its shape without collapsing.

A further requirement of emerging importance is that the gun propellant in its final extruded and cured form should exhibit low vulnerability to attack or accidental ignition. This property is especially important for gun propellant which is to be used in ammunition stored in a confined space, such as the hull of a battle tank, which is likely to be subject to enemy attack, in particular high velocity fragments from shell bursts and/or high velocity jet penetrators from shaped charge warheads.

Known colloidal gun propellants meet some but not all of these requirements. In particular, they tend to exhibit high vulnerability to shaped charge attack. It is known that the force constant of such compositions can be increased, for example, by the addition of high energy particulate explosive filler materials such as the sensitive cyclic nitramines RDX and HMX, but this has tended to increase yet further the vulnerability of the propellant.

It is one object of the present invention to overcome or at least mitigate in part this disadvantage.

Accordingly, the present invention provides an extrudable gun propellant composition comprising from 65 to 85% by weight of particulate explosive filler, from 10 to 30% by weight of a curable mixture of a functionally-terminated poly(nitratoalkyl-substituted)-alkyl ether prepolymer and a cross-linking agent, and from 1 to 12% by weight of an energetic plasticiser.

It has been found that gun propellant compositions according to this invention form extrudable doughs and when extruded into useable forms and cured, typically possess force constants in excess of 1200 kJ/kg. However, even though they may contain large amounts of sensitive particulate explosive such as RDX or HMX, they are unexpectedly significantly less vulnerable to shaped charge attack than colloidal propellants.

The present composition preferably comprises from 70 to 82% by weight of the explosive filler, from 12 to 25% by weight of the prepolymer/cross-linking agent mixture, and from 2 to 10, especially from 4 to 8% by weight of the energetic plasticiser. At prepolymer/cross-linking agent mixture loadings of less than 12% by weight the composition tends to be stiff and difficult to extrude, whereas at loadings in excess of 25% by weight the extrudate tends to collapse under its own weight.

In order to provide the composition with a high force constant, the explosive filler preferably comprises at least one cyclic nitramine, such as RDX or HMX.

Since the present composition contains both an energetic binder prepolymer and an energetic plasticiser, a relatively high force constant can be maintained by increasing to a certain extent the proportions of these ingredients in the composition whilst reducing the loading of explosive filler. Although this has the advantage of reducing the vulnerability of the composition, a reduction in the amount of explosive filler has a marked effect on the processibility of the composition. For example, where the filler comprises a fine particulate cyclic nitramine, the composition must contain a high proportion of filler of typically in excess of 78% otherwise the extrudate is too soft and tends to collapse under its own weight.

It has been discovered however that where up to 40% by weight, and preferably from 10% to 25% by weight, of the filler comprises the relatively low energy, insensitive explosive picrite (nitroguanidine), the total proportion of the filler in the composition can advantageously be reduced to less than 78%, or even less than 75%. The presence of needle-like crystalline particles of picrite in the composition assist in stiffening the extrudate without unduly reducing force constant. The effect of reducing both the total amount of filler and the high energy explosive content of that filler (ie by the inclusion of picrite) is to reduce further the vulnerability of the cured propellant composition.

The prepolymer preferably comprises a hydroxy-terminated poly (nitratoalkyl-substituted cyclic ether), the cyclic ether preferably being an oxetane or an oxirane. The cyclic ether preferably has not more than two, and most preferably has only one, nitratoalkyl substituent group. Suitable examples of cyclic ethers are 3-nitromethyl-3-methyloxetane and glycidyl nitrate. The molecular weight of the prepolymer, which should ideally be a viscous liquid within the temperature range 30–50° C., is preferably in the range 2,000 to 15,000 more preferably 3,000 to 10,000 in order to ensure that the extrudable propellant composition has adequate processability. Suitable hydroxy-terminated prepolymers based on nitratoalkyl-substituted cyclic ethers are disclosed in Applicant's copending applications Ser. No. 07/820,624 filed Jan. 28, 1992 and Ser. No. 07/820,692 filed Jan. 27, 1992.

The average functionality of the prepolymer is preferably between 1.5 and 3.5, more preferably between 1.7 and 3.2. It is desirable that the prepolymer/curing agent combination should not react to produce a highly cross-linked structure in the composition once extruded and cured. It is therefore preferable that when the average functionally of the prepolymer is 2 or less, the curing agent is polyfunctional whereas when the functionality of the prepolymer is greater than 2 the curing agent is difunctional.

The amount of cross-linking agent will normally be selected to ensure that it reacts approximately stoichiometrically with all available terminal groups on the prepolymer. It will not normally comprise more than 15 wt % of the prepolymer/cross-linking agent mixture.

The prepolymer is preferably hydroxy-terminated and the cross-linking agent an isocyanate, so that the prepolymer/cross-linking agent mixture is capable of undergoing a urethane-type curing reaction.

The presence of an energetic plasticiser has been found important to wet the explosive filler, to soften the composition thereby improving its extrudability, and to ensure that the composition possesses a high force constant. The energetic plasticiser preferably comprises at least one nitrato-plasticiser such as butane triol trinitrate or, more preferably, at least one nitroplasticiser such as bis-2,2 dinitropropyl formal, bis-2,2 dinitropropyl acetal or mixtures of the two. Nitroplasticisers, in particular in a ratio by weight of nitroplasticiser to prepolymer of between 1 to 2 and 1 to 5, are miscible with the prepolymer and considerably reduce the tackiness of the prepolymer especially where the prepolymer is hydroxy-terminated. Furthermore, nitroplasticisers have the added advantage that where the prepolymer is hydroxy-terminated and the cross-linking agent is an isocyanate, the presence of such plasticisers does not adversely affect the urethane-type curing reaction between the prepolymer and cross-linking agent and indeed can increase the pot life of the curing mixture at temperatures below 70° C. This in turn increases the processing time available before the cure reaction makes the composition too stiff to extrude.

Extrudable gun propellant compositions according to the present invention and cured extrudate prepared therefrom will now be described by way of example only.

Ingredients

The following ingredients were used in the Examples of extrudable gun propellant according to this invention.

Explosive fillers:

RDX: Micronised monomodal RDX, $[CH_2NNO_2]_3$

HMX: Micronised monomodal HMX, $[CH_2NNO_2]_4$

Picrite: Milled crystalline nitroguanidine

Prepolymers:

| | |
|---|---|
| Poly(NIMMO)1: Hydroxy-terminated difunctional poly(3-nitratomethyl-3-methyloxetane) having the following properties: | |
| Viscosity | |
| at 30° C. | 1610 poise |
| at 40° C. | 560 poise |
| at 60° C. | 100 poise |
| Hydroxyl Value | 18–22 mg KOH/g$^{-1}$ |
| Molecular Weight | 5,500 |
| Average Functionality | <2, typically 1.9 |
| Density | 1.26 g cm$^{-3}$ |
| Heat of Formation | −73.9 kcal mol$^{-1}$ |
| Heat of Explosion | 28.8 kcal mol$^{-1}$ |
| Poly(NIMMO)2: Hydroxy-terminated trifunctional poly(3-nitratomethyl-3-methyloxetane) having the following properties: | |
| Viscosity at 30° C. | 200 poise |
| Molecular Weight | 2–3,000 |
| Average Functionality | approximately 3 |

Poly(NIMMO)1 and 2 were both prepared by the general process described in Applicant's Copending application Ser. No. 07/820,624 filed Jan. 28, 1992.

Plasticiser:

BDNPA/F: 50/50 by weight mixture of bis-dinitropropylacetal and bis-dinitropropylformal, marketed by Aerojet Corporation, USA.

Cross-linking agents:

Desmodur N100: Polyfunctional, viscous isocyanate marketed by Bayer AG, West Germany.

MD1: 4,4 di-isocyanato-diphenylmethane.

Catalyst:

DBDTL: dibutyl tin dilaurate.

EXAMPLE 1

| Ingredient | Parts by Weight |
|---|---|
| RDX | 80.4 |
| Poly(NIMMO)1 | 14.16 |
| Desmodur N100 | 0.54 |
| BDNPA/F | 4.9 |
| DBDTL | 50 ppm of Poly(NIMMO)1 |

The dough produced by mixing these ingredients together was found to be extrudable within the temperature range 45–60° C., possessed a good pot life at these temperatures, and produced a smooth and slightly tacky extrudate. The mechanical properties of the cured extrudate were found to be comparatively soft due to the low cross-link density of the cured poly(NIMMO)1, and its insoluble rubber content as measured by solvent extraction was found to vary between 40 and 60%.

EXAMPLE 2

| Ingredient | Parts by Weight |
|---|---|
| RDX | 78.7 |
| Poly(NIMMO)1 | 15.57 |
| Desmodur N100 | 0.54 |
| BDNPA/F | 5.19 |
| DBDTL | 50 ppm of Poly(NIMMO)1 |

The dough produced by mixing these ingredients together was extrudable at 45° C. and possessed a good pot life at this temperature.

EXAMPLE 3

| Ingredient | Parts by Weight |
|---|---|
| RDX | 67.3 |
| Picrite | 7.8 |
| BDNPA/F | 6.4 |
| Poly(NIMMO)1 | 17.19 |
| Desmodur N100 | 1.31 |
| DBDTL | 50 ppm of Poly(NIMMO)1 |

EXAMPLE 4

The ingredients and their parts by weight in the extrudable gun propellant of the example were the same as those specified for Example 3, except that RDX was replaced by HMX.

EXAMPLE 5

| Ingredient | Parts by Weight |
|---|---|
| HMX | 64.3 |
| Picrite | 9.1 |
| BDNPA/F | 6.8 |
| Poly(NIMMO)1 | 18.24 |
| Desmodur N100 | 1.56 |
| DBDTL | 50 ppm of Poly(NIMMO)1 |

EXAMPLE 6

| Ingredient | Parts by Weight |
|---|---|
| RDX | 67 |
| Picrite | 8 |
| Poly(NIMMO)2 | 16.3 |
| BDNPA/F | 6.7 |
| MD1 | 1.8 |
| DBDTL | — |

Each of the doughs produced by mixing the ingredients of Examples 3 to 6 was found to be extrudable within the temperature range 45–60° C., possessed a good pot life at these temperatures, was non tacky, and was found to flow only under pressure so that in its precured state the extrudate maintained its shape and did not collapse. The cured product of Example 6 was firmer than that produced using the ingredients of Examples 3 to 5 because its rubbery component had a higher cross-link density. The rubbery component of the cured product of Example 6 had an insoluble rubber content of 75–85%.

Preparative Method—General Procedure

Extrudable gun propellant compositions according to the formulations given in the Examples, and extrudate made therefrom, were prepared using the following procedure.

1. A mixture of the nitroplasticiser, prepolymer, and cure catalyst (if any) was added to a vertical planetary mixer. Mixing was commenced and a sufficient quantity of the dry particulate cyclic nitramine added until a soft premix had formed. The temperature of the premix was maintained at 50° C. throughout.

2. The soft premix was transferred to a horizontal incorporator and the remainder of the cyclic nitramine was added in incremental steps and blended into the premix. This was followed by the stepwise addition and blending in of picrite, if present. Finally, the cross-linking agent was added and blended in for 10 minutes. The temperature within the incorporator was maintained at 60° C. throughout addition and blending.

3. The resulting propellant dough was then removed from the incorporator and loaded into the barrel of a heated ram extruder fitted with die adapted to produce a slotted tube extrudate. The temperature of the extruder was maintained at 60° C. The piston was pressurised to a point whereby a convenient rate of extrusion was obtained. The extrudate was collected on trays and heated for 100 hours at 60° C. to complete the cure of the prepolymer and cross-linking agent.

Where a cure catalyst was employed, the amount used was selected to ensure that the mixture of the prepolymer, cross-linking agent and plasticiser had adequate pot life to allow blending and extrusion to be completed before the propellant becomes too stiff due to curing. An adequate definition of pot life was found to be the time taken for the viscosity of the prepolymer/cross-linking agent mixture to reach 20,000 poise. Observed pot life times for such mixtures are given in Table 1 below.

TABLE 1

| Mixture Ingredients, Parts by Weight | | | | Temperature (° C.) | Pot Life (mins) |
|---|---|---|---|---|---|
| Poly(NIMMO)1 | BDNPA/F | Desmodur N100 | DBDTL (ppm) | | |
| 2.79 | — | 0.21 | 50 | 60 | 123 |
| 2.79 | — | 0.21 | 50 | 70 | 83 |
| 2.79 | 1 | 0.21 | 50 | 50 | 310 |
| 2.79 | 1 | 0.21 | 50 | 60 | 155 |
| 2.79 | 1 | 0.21 | 50 | 70 | 82 |

Studies were conducted on the viscosity rise during cure of these mixtures and showed a well defined termination of pot life with very little increase in viscosity until the mixtures gelled. From Table 1, it may be seen that presence of nitroplasticiser has the advantageous effect of increasing pot life at cure temperature below 70° C.

TABLE 2

Specific Energy Content of Cured Propellant

| Example | Force Constant (kJ/kg) |
|---|---|
| 1 | 1200–1250 |
| 2 | 1200–1250 |
| 3 | 1213 |
| 4 | 1236 |
| 5 | 1228 |
| 6 | 1200–1250 |

Vulnerability Assessment

In order to assess the vulnerability of propellant compositions according to the invention, the following shaped charge attack test was employed.

A shaped charge is mounted six charge diameters above a 25.4 mm thick mild steel cover plate, and twelve charge diameters above a target comprising a 2 kg mass of extruded, cured propellant composition to be tested. The shaped charge consists of a 63 mm diameter cylindrical explosive charge with a conical re-entrant front end lined with a 45° conical copper liner. The explosive filling is a cast mixture consisting of 86% particulate HMX dispersed in 14% rubbery binder.

The target consists of a 165 mm long section of a 120 mm diameter combustible cartridge case lying on its side, which is loaded with sticks of extruded cured propellant composition under test having a total mass of 2 kg. Each stick consists of a tube of propellant open at both ends and having a longitudinal slot therein extending its full length. The thickness, or web-size, of the stick is the difference between its outside and inside diameters.

Beneath the target is located a series of steel plates interleaved with cardboard to arrest the shaped charge jet following its passage through the target. A blast gauge is mounted 1.9 m from the target, just above the level of the cover plate.

When the shaped charge is fired, the over-pressure generated by the response of the target is recorded. The net explosive output is expressed as a mass ratio, which is the mass of a detonated standard explosive mixture (a 60:40 mixture of RDX and TNT) giving the same over-pressure output divided by the propellant mass.

For each formulation tested firings are carried out over a range of web-sizes, and the results presented as a plot of explosive output (mass ratio) against web-size.

Figure 2:
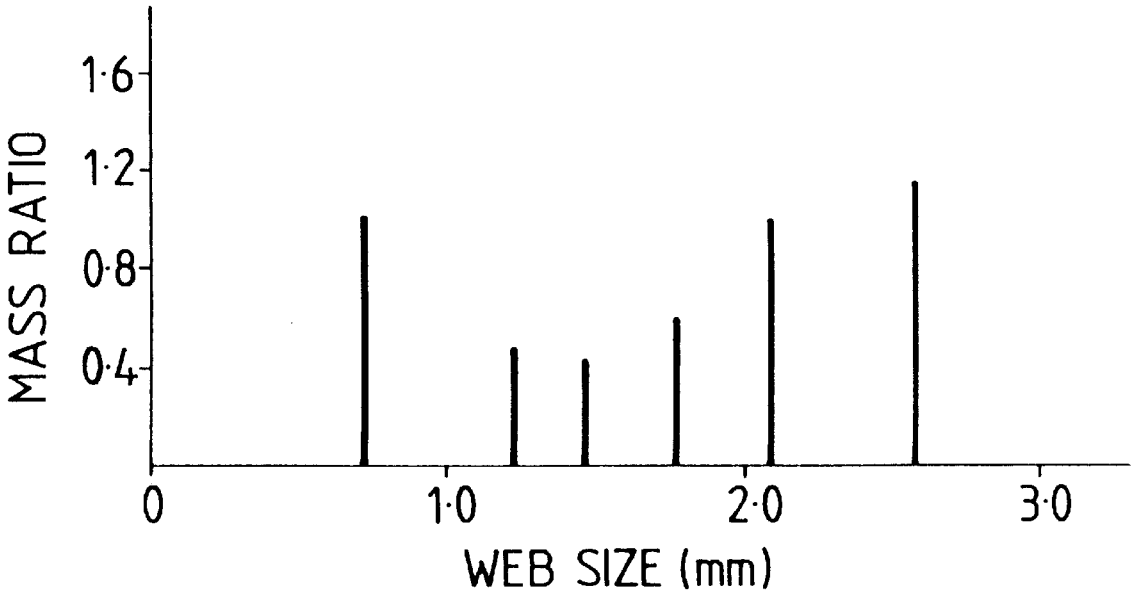

The formulation of Example 5 was assessed using the test, and the results are given in FIG. 1. By comparison, the results of the same vulnerability tested conducted on a conventional triple base colloidal propellant (nitroglycerine/nitrocellulose/picrite) of high energy content (Force Constant=1135 kJ/kg) are given in FIG. 2. These results show that the composition according to Example 5 is considerably less vulnerable to shaped charge attack than a conventional triple base gun propellant.

What is claimed is:

1. An extrudable gun propellant composition comprising the following components:

65–85% by weight of particulate explosive filler,

10–30% by weight of a curable mixture of a functionally-terminated poly (nitratoalkyl-substituted)alkyl ether prepolymer and a cross-linking agent, and 1–12% by weight of an energetic plasticizer, wherein from 10 to 40% by weight of the explosive filler comprises nitroguanidine, the remainder having a specific energy content greater than nitroguanidine.

2. An extrudable gun propellant composition consisting essentially of the following components:

70–82% by weight of particulate explosive filler,

12–25% by weight of a curable mixture of a functionally-terminated poly(nitratoalkyl-substituted)alkyl ether prepolymer and a cross-linking agent, and 2–10% by weight of an energetic plasticizer, wherein from 10 to 40% by weight of the explosive filler comprises nitroguanidine, the remainder having a specific energy content greater than nitroguanidine.

3. The composition according to claim 1 wherein the remainder of the explosive filler comprises at least one cyclic nitramine.

4. The composition according to claim 1 wherein from 10–25% by weight of the explosive filler comprises nitroguanidine.

5. The composition according to claim 1 wherein the explosive filler comprises less than 78% by weight of the composition.

6. The composition according to claim 1 wherein the prepolymer comprises a hydroxy-terminated poly (nitratoalkyl-substituted cyclic ether) and the cross-linking agent comprises an isocyanate.

7. The composition according to claim 1 wherein the average functionality of the prepolymer is between 1.5 and 3.5 and the cross-linking agent is difunctional when the average functionality of the prepolymer is greater than two and polyfunctional when the average functionality of the prepolymer is between 1.5 and 2.

8. The composition according to claim 1 wherein the energetic plasticizer comprises a nitroplasticizer.

9. An extruded gun propellant having a composition comprising the cured composition according to claim 1.

* * * * *